US011580944B2

(12) United States Patent
Chen et al.

(10) Patent No.: US 11,580,944 B2
(45) Date of Patent: Feb. 14, 2023

(54) METHOD AND ELECTRONIC DEVICE FOR ADJUSTING ACCOMPANIMENT MUSIC

(71) Applicant: Airoha Technology Corp., Hsinchu (TW)

(72) Inventors: Hsuan-Yu Chen, Taipei (TW); Chun-Lung Chen, Taipei (TW); I-Ting Lee, Taipei (TW); Kuan-Li Chao, Taipei (TW); Kuo-Wei Kao, Taipei (TW); Neo Bob Chih-Yung Young, Taipei (TW); Kuo-Ping Yang, Taipei (TW)

(73) Assignee: AIROHA TECHNOLOGY CORP.

( * ) Notice: Subject to any disclaimer, the term of this patent is extended or adjusted under 35 U.S.C. 154(b) by 218 days.

(21) Appl. No.: 17/115,844

(22) Filed: Dec. 9, 2020

(65) Prior Publication Data

US 2021/0241738 A1 Aug. 5, 2021

(30) Foreign Application Priority Data

Feb. 4, 2020 (TW) ..... 109103391

(51) Int. Cl.
*G10H 1/36* (2006.01)
*G10H 1/00* (2006.01)

(52) U.S. Cl.
CPC ..... *G10H 1/361* (2013.01); *G10H 1/0008* (2013.01); *G10H 2210/005* (2013.01); *G10H 2210/066* (2013.01); *G10H 2210/561* (2013.01)

(58) Field of Classification Search
CPC ..... G10H 1/361; G10H 1/0008; G10H 2210/005; G10H 2210/066; G10H 2210/561
USPC ..... 84/634
See application file for complete search history.

(56) References Cited

U.S. PATENT DOCUMENTS 5,296,643 A * 3/1994 Kuo ..... H04H 20/31 84/634
5,455,378 A * 10/1995 Paulson ..... G10H 1/361 84/610
5,876,213 A * 3/1999 Matsumoto ..... G10H 1/366 84/610
8,626,497 B2 * 1/2014 Lin ..... G10H 1/361 84/613
9,123,315 B1 * 9/2015 Bachand ..... G10H 1/20
9,489,932 B2 * 11/2016 Morell ..... G10H 1/0025
2006/0016323 A1 * 1/2006 Hayakawa ..... G10H 1/20 84/619
2014/0305284 A1 * 10/2014 Cosgrove ..... G09B 15/001 84/478
2018/0253489 A1 * 9/2018 Morell ..... G06F 16/635
(Continued)

FOREIGN PATENT DOCUMENTS

CA 2261275 A1 * 12/1997
CN 1150289 A * 5/1997 ..... G10H 1/366
(Continued)

*Primary Examiner* — Christina M Schreiber
(74) *Attorney, Agent, or Firm* — McClure, Qualey & Rodack, LLP

(57) ABSTRACT

A method for adjusting accompaniment music is disclosed. The method transposes the musical key of at least one section of the accompaniment music such that a song will have different musical key transpositions for different sections of the accompaniment music, so that singers whose vocal ranges are narrow can sing songs after the adjustment.

12 Claims, 6 Drawing Sheets

(56) References Cited

U.S. PATENT DOCUMENTS

| | | | | |
|---|---|---|---|---|
| 2019/0392803 | A1* | 12/2019 | Matsumoto | G10H 1/0008 |
| 2020/0135237 | A1* | 4/2020 | Gauvin | G11B 27/036 |
| 2021/0241738 | A1* | 8/2021 | Chen | G10H 1/361 |

FOREIGN PATENT DOCUMENTS

| | | | | | |
|---|---|---|---|---|---|
| CN | 1150289 | A | | 5/1997 | |
| CN | 110402464 | A | * | 11/2019 | G10H 1/0008 |
| CN | 110459196 | A | * | 11/2019 | |
| DE | 102006028330 | A1 | * | 1/2008 | G10H 1/20 |
| JP | 2010518428 | A | * | 5/2010 | |
| WO | WO-2021245234 | A1 | * | 12/2021 | |

* cited by examiner

70

| Transposal / Section of accompaniment music 51 | -2 | -1 | 0 | +1 | +2 |
|---|---|---|---|---|---|
| 1 | 0 | 1 | 1 | 0 | 0 |
| 2 | 0 | 1 | 1 | 0 | 0 |
| 3 | 0 | 1 | 0 | 0 | 0 |
| 4 | 1 | 1 | 1 | 0 | 0 |
| 5 | 0 | 0 | 1 | 1 | 0 |
| 6 | 0 | 0 | 0 | 1 | 0 |
| 7 | 0 | 1 | 1 | 1 | 0 |
| 8 | 0 | 0 | 0 | 1 | 1 |
| 9 | 0 | 0 | 0 | 1 | 0 |
| 10 | 0 | 1 | 1 | 1 | 0 |
| 11 | 0 | 0 | 0 | 1 | 1 |
| 12 | 0 | 0 | 0 | 0 | 1 |

70

70

FIG. 6

70

| Transposal / Section of accompaniment music 51 | -2 | -1 | 0 | +1 | +2 |
|---|---|---|---|---|---|
| 1 | 0 | 4 | 1 | 0 | 0 |
| 2 | 0 | 3 | 1 | 0 | 0 |
| 3 | 0 | 2 | 0 | 0 | 0 |
| 4 | 1 | 1 | 1 | 0 | 0 |
| 5 | 0 | 0 | 1 | 7 | 0 |
| 6 | 0 | 0 | 0 | 6 | 0 |
| 7 | 0 | 1 | 1 | 5 | 0 |
| 8 | 0 | 0 | 0 | 4 | 1 |
| 9 | 0 | 0 | 0 | 3 | 0 |
| 10 | 0 | 1 | 1 | 2 | 0 |
| 11 | 0 | 0 | 0 | 1 | 1 |
| 12 | 0 | 0 | 0 | 0 | 1 |

70

70

FIG. 7

70

| Transposal / Section of accompaniment music 51 | -2 | -1 | 0 | +1 | +2 |
|---|---|---|---|---|---|
| 1 | 0 | 1 | 1 | 0 | 0 |
| 2 | 0 | 1 | 1 | 0 | 0 |
| 3 | 0 | 1 | 0 | 0 | 0 |
| 4 | 1 | 1 | 1 | 0 | 0 |
| 5 | 0 | 0 | 1 | 1 | 0 |
| 6 | 0 | 0 | 0 | 1 | 0 |
| 7 | 0 | 1 | 1 | 1 | 0 |
| 8 | 0 | 0 | 0 | 1 | 1 |
| 9 | 0 | 0 | 0 | 1 | 0 |
| 10 | 0 | 1 | 1 | 1 | 0 |
| 11 | 0 | 0 | 0 | 1 | 1 |
| 12 | 0 | 0 | 0 | 0 | 1 |

70

70

FIG. 8

70 70

| Transposal / Section of accompaniment music 51 | -2 | -1 | 0 | +1 | +2 |
|---|---|---|---|---|---|
| 1 | 0 | 1 | 1 | 0 | 0 |
| 2 | 0 | 1 | 1 | 0 | 0 |
| 3 | 0 | 1 | 0 | 0 | 0 |
| 4 | 1 | 1 | 1 | 0 | 0 |
| 5 | 0 | 0 | 1 | 1 | 0 |
| 6 | 0 | 0 | 0 | 1 | 0 |
| 7 | 0 | 1 | 1 | 1 | 0 |
| 8 | 0 | 0 | 0 | 1 | 1 |
| 9 | 0 | 0 | 0 | 1 | 0 |
| 10 | 0 | 1 | 1 | 1 | 0 |
| 11 | 0 | 0 | 0 | 1 | 1 |
| 12 | 0 | 0 | 0 | 0 | 1 |

70

70

70

FIG. 9

METHOD AND ELECTRONIC DEVICE FOR ADJUSTING ACCOMPANIMENT MUSIC

BACKGROUND OF INVENTION

1. Field of the Invention

The present invention relates to a method for adjusting accompaniment music through an electronic device, which can be applied in karaoke, for example.

2. Description of Related Art

When singing karaoke, it is common that some singers are unable to sing notes that are outside of their vocal range. To overcome this problem, there is a need to transpose the musical key of a song. Generally, on the basis of the singer's experience, the singer will transpose the musical key to a higher or lower key before singing. It is actually very difficult to transpose the musical key when the singer is already singing because singing requires quick responses. Therefore, few people will do so.

U.S. Pat. No. 5,296,643 (Automatic musical key adjustment system for karaoke equipment) discloses a method to firstly adjust the musical key of each song and produce sections of accompaniment music with six different vocal ranges, i.e., bass, baritone, tenor, contralto, mezzo-soprano, and soprano. Then the operator can select a vocal range that is suitable for a particular singer. U.S. Pat. No. 5,296,643 has no discussion on how the transposing is conducted. It should be a consistent transposal of the whole song. For example, for a singer with a bass voice, the whole song will be transposed to a lower key. U.S. Pat. No. 5,296,643 does not take account of the width of singer's vocal range. In fact, the vocal ranges of many people do not fall into any of the 6 categories, and the vocal ranges of singers can differ greatly.

CN Patent 1150289 (Karaoke Apparatus detecting register of live vocal to tune harmony vocal) discloses a detecting apparatus to analyze the captured singing voice and identify the vocal range of the live singing voice, and then to automatically adjust the accompaniment music. That is to say, the adjustment is performed during the singing. However, when the singer sings off tune (especially when singing an unfamiliar song), the apparatus will make an inaccurate prediction.

For singers with a narrow vocal range, what troubles them is that there are few songs that they can sing, even if the songs are adjusted in advance. The reason is that they still cannot sing the song when it is consistently adjusted such as by transposing the musical key downward by one or two semitones. After the adjustment, they may be able to sing some of the high notes but not other high notes. However, if the song is adjusted downward by two semitones, they may not be able to sing the low notes.

Such is particularly the case for a song requiring a wide vocal range. However, many people are especially fond of singing songs requiring a wide vocal range in spite of their own narrow vocal ranges. Therefore, there is a need to overcome this problem.

SUMMARY OF THE INVENTION

In view of the above-mentioned issue, the main object of the present invention is to provide a method for adjusting accompaniment music to overcome the existing problem, wherein the accompaniment music of a song can be adjusted in advance to have different musical key transposals for different sections (instead of one consistent transposal of the musical key) so that more singers, especially those singers having narrow vocal ranges, can sing songs which exceed their vocal ranges and which they would otherwise be unable to sing.

To accomplish the above object, the present invention provides a method to adjust the accompaniment music, which is used to adjust the keys of a plurality of sections in the accompaniment music of a song, with each section of accompaniment music corresponding to each segment of the song by the original singer. This method will be adopted when a singer's vocal range is narrower than the overall original vocal range. The method comprises:

comparing the singer's vocal range with each segment of the song by the original singer to determine whether the singer's vocal range covers each segment of the song by the original singer; and on the basis of the above step, transposing the musical key of at least one section of accompaniment music such that the segment of the song by the original singer corresponding to the at least one transposed section of accompaniment music is covered by the singer's vocal range, and the musical key of at least one section of the accompaniment music is not transposed, and the segment of the song by the original singer corresponding to the at least one section of accompaniment music without transposal is covered by the singer's vocal range.

According to the embodiment, the musical keys of at least two sections of accompaniment music are transposed, and the two sections of accompaniment music are transposed to different keys. The plurality of sections of accompaniment music comprise a total of m segments, which are divided into n groups of transposed sections of accompaniment music, with each group of transposed sections of accompaniment music having y sections of accompaniment music, wherein, within each group, the sections of accompaniment music are transposed for the same number of [keys]; and $5 \leq m \leq 1000$, $3 \leq n \leq m-2$, and $1 \leq y \leq 500$. According to the preferred embodiment, it is recommended to seek the smallest number n.

BRIEF DESCRIPTION OF THE DRAWINGS

FIG. 6 illustrates a first embodiment showing a section of accompaniment music becoming a transposed section of accompaniment music via adjustment of the musical key.

FIG. 7 is a schematic view showing how the first embodiment in FIG. 6 obtains the result through computing.

FIG. 8 illustrates a second embodiment showing a section of accompaniment music becoming a transposed section of accompaniment music via adjustment of the musical key.

FIG. 9 illustrates a third embodiment showing a section of accompaniment music becoming a transposed section of accompaniment music via adjustment of the musical key.

DETAILED DESCRIPTION OF THE INVENTION

For better understanding of the technical contents of the present invention, detailed descriptions are provided below with reference to preferred embodiments.

Figure 1:
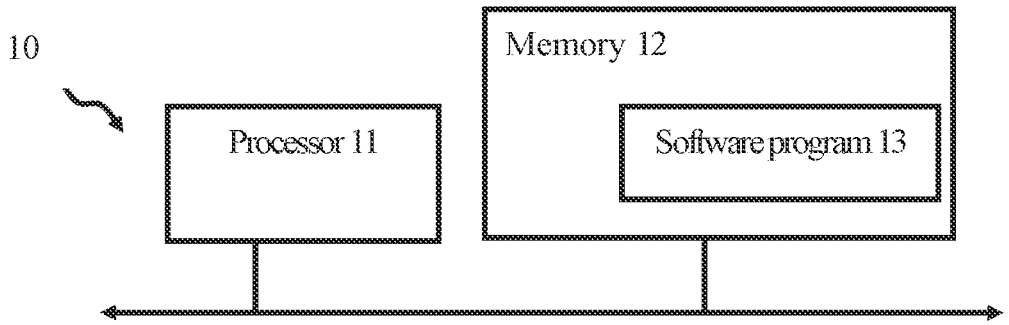
FIG. 1 is an electronic block diagram of the electronic device for adjusting accompaniment music of the present invention.
Figure 2:
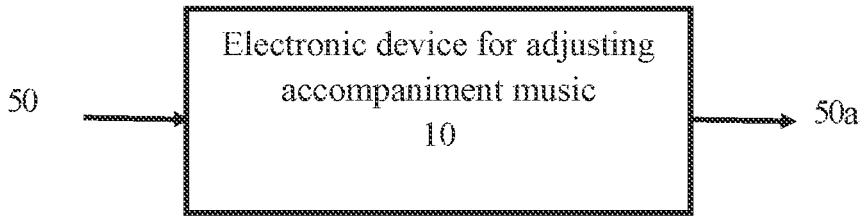
FIG. 2 is a functional diagram of the electronic device for adjusting accompaniment music of the present invention.

Please refer to FIG. 1 and FIG. 2, which depict an electronic device 10 for adjusting accompaniment music of the present invention. The electronic device 10 for adjusting accompaniment music includes a processor 11 and a memory 12, and the memory 12 stores a software program 13. The processor 11 executes the software program 13 to process a song 50 to output an adjusted song 50*a*. The song 50 referred to in the present invention is a song 50 with accompaniment music and lyrics for people to sing so that a user can sing the adjusted song 50*a*. The electronic device 10 for adjusting accompaniment music can be a computer, a mobile phone, a tablet, or a karaoke device.

Please refer to the operating flow diagram of the method for adjusting accompaniment music according to the invention, i.e., the flow diagram of the processor 11 executing the software program 13, and meanwhile refer to FIG. 4 to FIG. 9.

Step 300: Obtaining a singer's vocal range 62. A singer's vocal range 62 can be input into the electronic device 10 for adjusting accompaniment music. Alternatively, the singer's vocal range 62 can be detected by the electronic device 10 for adjusting accompaniment music or by another software program. As detection of the singer's vocal range 62 is a prior art, it is not detailed herein.

Step 301: Determining whether the singer's vocal range 62 is narrower than an overall original vocal range 52T.

Figure 4:
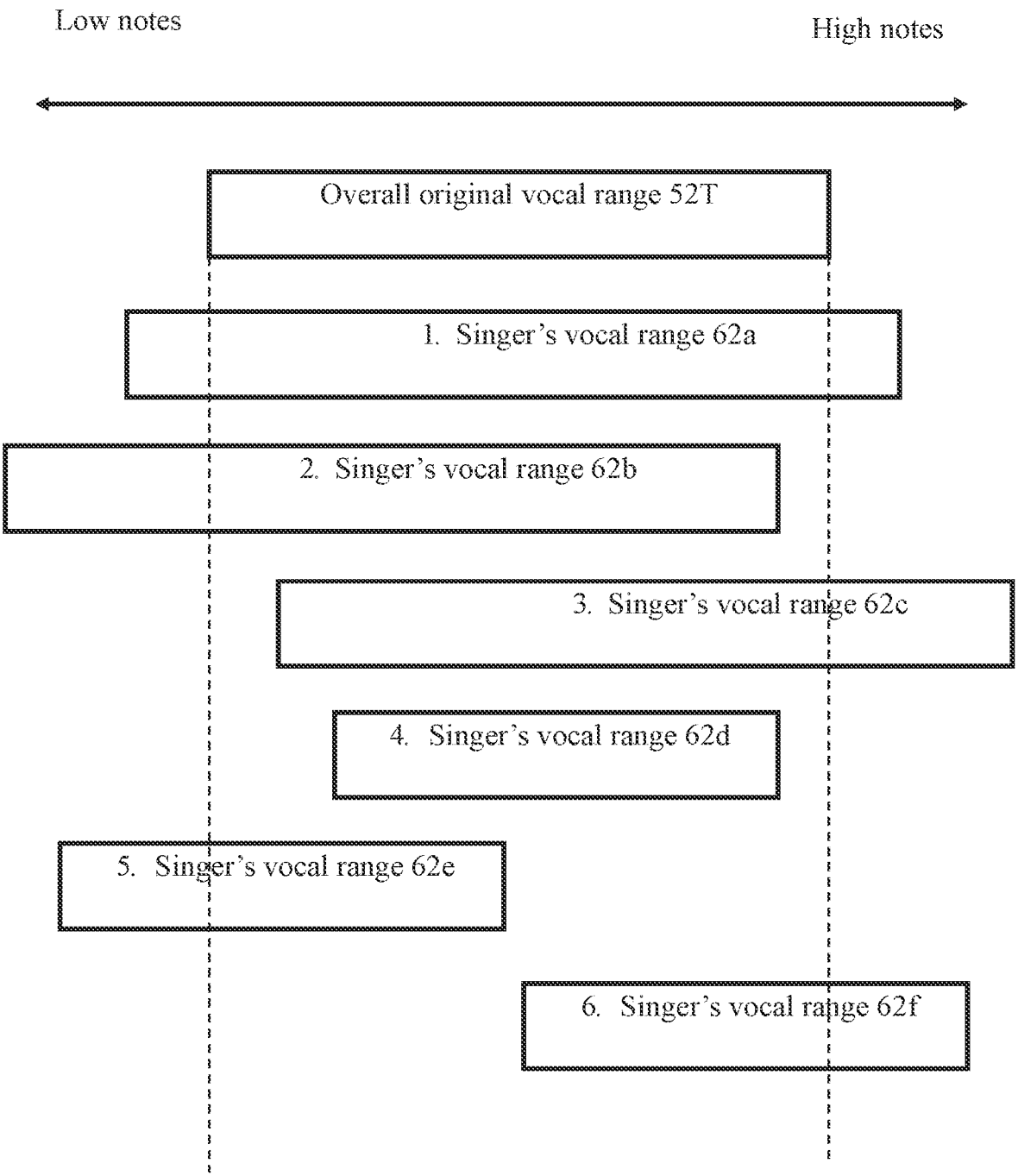
FIG. 4 is a diagram comparing the overall original vocal range with a singer's vocal range according to the present invention.

Now please refer to FIG. 4, which is a diagram comparing the overall original vocal range 52T with the singer's vocal range 62. The overall original vocal range 52T refers to the vocal range (from highest note to lowest note) required to sing the song 50, such as from F2 to A5. The singer's vocal range 62 refers to the vocal range of the singer. For example, some people have a soprano range, other people have a baritone range, and still others have a bass range. Some people have a wide vocal range and can sing most songs; other people have a narrow vocal range and can only sing a small number of songs.

FIG. 4 lists the vocal ranges 62 of six singers. The first singer's vocal range 62*a* covers the whole overall original vocal range 52T; therefore, the singer's vocal range 62*a* is wider than the overall original vocal range 52T. Thus, Step 303 can be conducted, with no transposal of any sections of the accompaniment music 51.

The $2^{nd}$ and $3^{rd}$ singer's vocal ranges 62*b*/62*c* do not cover the whole overall original vocal range 52T, but the $2^{nd}$ and $3^{rd}$ singer's vocal ranges 62*b*/62*c* are wider than the overall original vocal range 52T. Therefore, the key of the song 50 can be transposed downward for the $2^{nd}$ singer or upward for the $3^{rd}$ singer. Thus, Step 303 can be conducted to transpose the sections of the accompaniment music 51 consistently.

The $4^{th}$ to $6^{th}$ singer's vocal ranges 62*d*/62*e*/62*f* are all narrower than the overall original vocal range 52T. Therefore, it is not suitable to conduct Step 303 to transpose all the sections of the accompaniment music 51 consistently. Thus, Step 302 is conducted.

Step 302: Comparing the singer's vocal range 62 with each original vocal range segment 52 of the overall original vocal range 52T to determine whether the singer's vocal range 62 covers each original vocal range segment 52.

Figure 5:
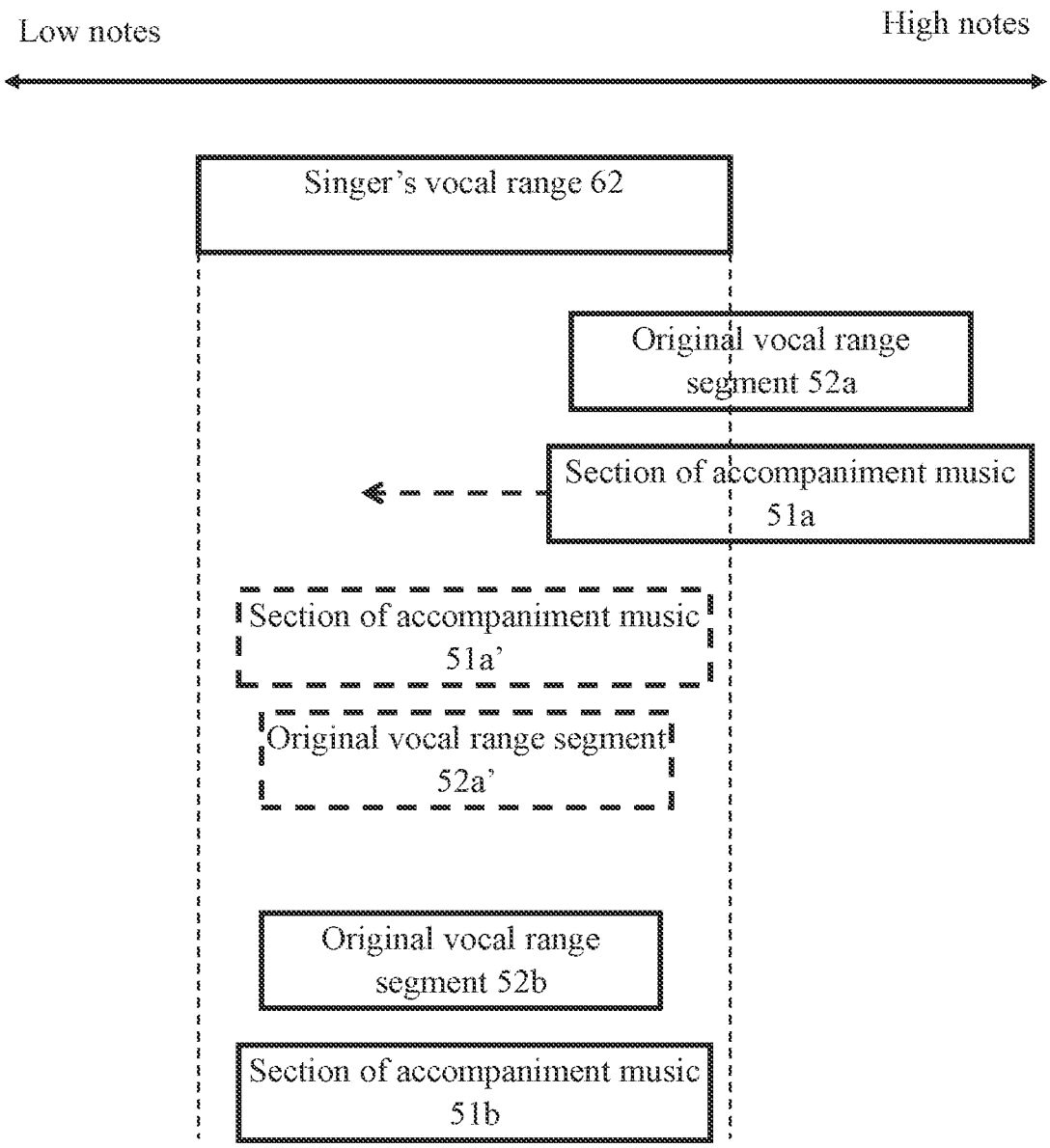
FIG. 5 is a diagram showing the transposal of a musical key for a section of accompaniment music according to the present invention.

Please refer to FIG. 5, which is a diagram showing the transposal of the musical key for a section of the accompaniment music 51. An accompaniment music 51 of the song 50 can be divided into a plurality of sections. Normally, sections can be based on each music segment or verse of lyrics. For example, in the case of the song [Happy Birthday], the lyrics may be sung as follows: [Happy Birthday to you, Happy Birthday to you, Happy Birthday, Happy Birthday, Happy Birthday to you]. It can be divided into 5 sections of the accompaniment music 51. An accompaniment music 51 of the song 50 can be divided into sections of the accompaniment music 51 manually or by a software program. Sections may not be dependent on each verse of lyrics because two verses of lyrics may have a tight connection and can be combined in one section of the accompaniment music 51.

In the embodiment shown in FIG. 5, there is one section 51*a* of the accompaniment music 51 and another section 51*b* of the accompaniment music 51. The section 51*a* of the accompaniment music 51 corresponds to an original vocal range segment 52*a*, and the section 51*b* of the accompaniment music 51 corresponds to an original vocal range segment 52*b*.

In Step 302, the singer's vocal range 62 is compared with the original vocal range segment 52*a*. It is found that, for the singer's vocal range 62, the original vocal range segment 52*a* is too high. Therefore, this section of the accompaniment music 51*a* is transposed to a lower key and becomes a new section of the accompaniment music 51*a*'. The new section of the accompaniment music 51*a*' corresponds to the new segment of the song by the original singer 52*a*'. Due to this adjustment, the singer's vocal range 62 can cover the original vocal range segment 52*a'*.

When comparing the singer's vocal range 62 with the original vocal range segment 52*b*, it is found that the singer's vocal range 62 covers the original vocal range segment 52*b*. Therefore, transposal may not be necessary for the section of the accompaniment music 51*b*.

Step 304: The musical key of the section of the accompaniment music 51 is transposed such that the original vocal range segment 52 corresponding to the at least one transposed section of the accompaniment music 51 is covered by the singer's vocal range 62. Step 304 is a description of the above embodiment shown in FIG. 5.

The sections of the accompaniment music 51 referred to in the present invention are sections with corresponding lyrics; i.e., each section of the accompaniment music 51 corresponds to an original vocal range segment 52. To transpose the musical key of an instrumental section with no lyrics to be sung, it is recommended that consistency with the preceding or the succeeding section of the accompaniment music 51 be maintained, or that the musical key not be transposed. For example, if the section of the accompaniment music 51 preceding the instrumental section is transposed upward by one key, the instrumental section can also be transposed upward by one key.

Figure 3:
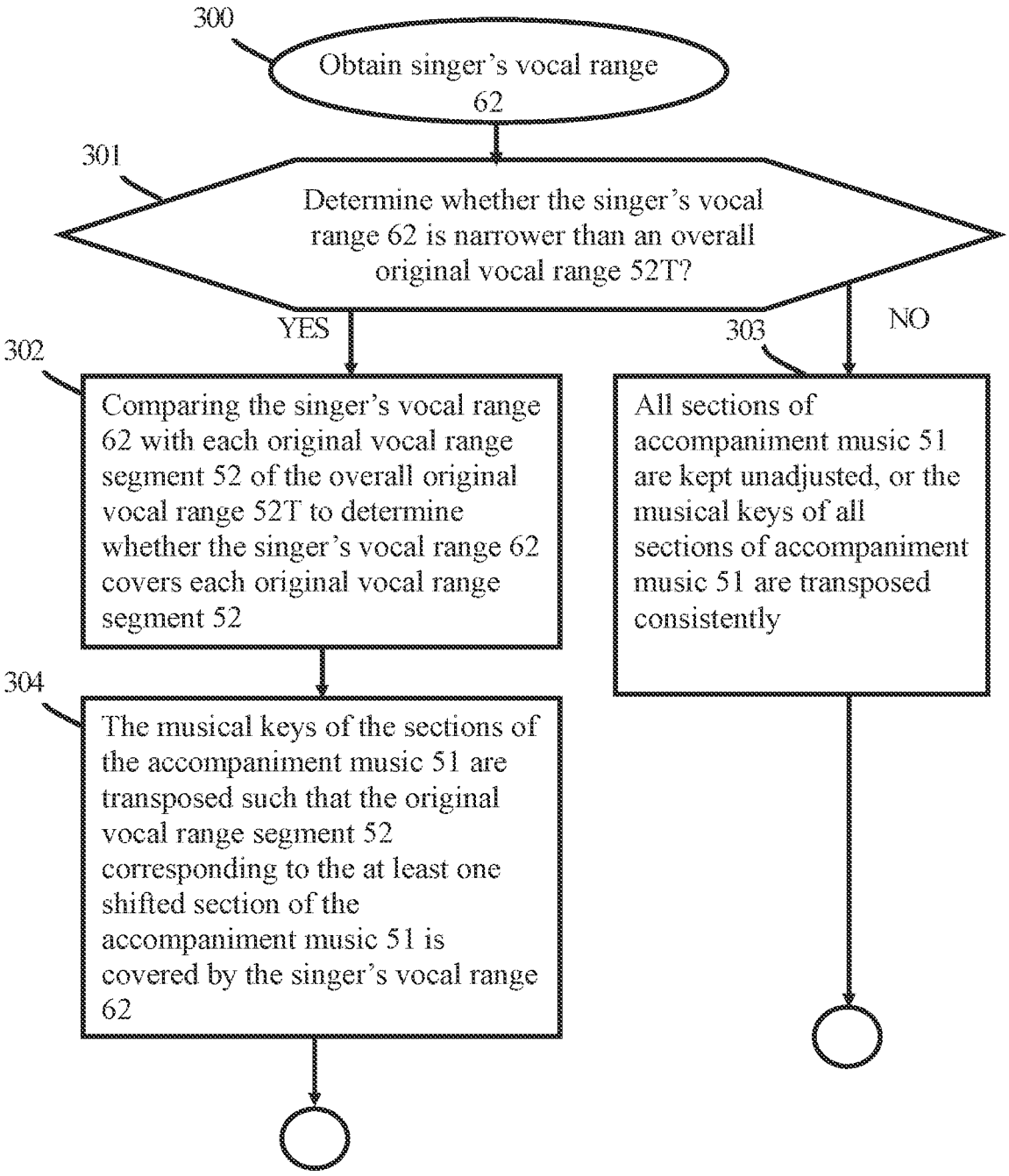
FIG. 3 is an operating flow diagram of the method for adjusting accompaniment music of the present invention.

To realize the object of the flow diagram shown in FIG. 3, there are multiple methods. Below is a description of a preferred method. Now please refer to FIG. 6. If a song 50 is divided into 12 sections of the accompaniment music 51, then based on the explanations of the above Step 302 and Step 304, if the singer's vocal range 62 can cover the segment of the song by the original singer corresponding to the [1] section of the accompaniment music 51 when the 1st section of the accompaniment music 51 is transposed downward by one key or is left unadjusted, a flag [1] is used to mark it. A flag [0] means that the singer's vocal range 62 cannot cover the original vocal range segment 52 corresponding to the 1st section of the accompaniment music 51. For example, the 1st section of the accompaniment music 51 cannot be transposed downward by two keys, or upward by one key, or upward by two keys.

Normally, the unit used to transpose the musical key is one semitone. It is to be noted that, in the present invention, transposing by one key means transposing by one semitone. Of course, as required, transposing by one key can also be defined as transposing by two semitones, three semitones, four semitones, etc.

The array listed in FIG. 6 clearly shows the conditions under which each section of the accompaniment music 51 can be transposed or cannot be transposed. As shown in FIG. 6, the $1^{st}$ to $4^{th}$ sections of the accompaniment music 51 can be grouped into one transposed section of accompaniment music 70; i.e., the $1^{st}$ to $4^{th}$ sections of the accompaniment music 51 are all transposed downward by one key. The $5^{th}$ to $11^{th}$ sections of the accompaniment music 51 can be grouped into one transposed section of the accompaniment music 70 because they are all transposed upward by one key. However, the $12^{th}$ section of the accompaniment music 51 has an independent transposed section of the accompaniment music 70 because it is transposed upward by two keys.

There is more than one way to produce a transposed section of the accompaniment music 70 mathematically. The method shown in FIG. 7 is to continuously add 1 from bottom to top, and when a 0 is encountered, it is not added. Now please refer to the result in FIG. 7. The largest number in each row is chosen as a basis for a transposed section of the accompaniment music 70 to be selected. For example, when the $1^{st}$ section of the accompaniment music 51 is transposed downward by one key, and the number is 4, then it is decided that the $1^{st}$ section of the accompaniment music 51 will be transposed downward by one key, and similarly, the $1^{st}$ to $4^{th}$ sections of the accompaniment music 51 will all be transposed downward by one key and grouped as one transposed section of the accompaniment music 70.

A detailed explanation of the above computing is provided below:

Step 1: According to the above explanations for FIG. 6, firstly, an [array to transpose musical keys] such as that shown in FIG. 6 is produced. Flag [1] means the singer's vocal range 62 can cover the original vocal range segment 52 corresponding to the section of the accompaniment music 51 when the section of the accompaniment music 51 is transposed or not transposed. Otherwise, it is marked with a flag 0. The flag values in FIG. 6 are 1 or 0.

Step 2: From bottom to top, the flag values in each line of the array are accumulated, and the accumulated value is used to replace the original flag value. When a 0 is encountered, the accumulation becomes 0.

Step 3: From top to bottom, the largest flag value in each row is found. From top to bottom, this flag value is reduced to 1. Using this method, the next row is searched, and so on until the last row is searched.

Step 4: The path of Step 3 is recorded for use as the basis for grouping a transposed section of accompaniment music 70 (as indicated by the dotted box in FIG. 7).

It is to be noted that there are many solutions for transposing the sections of the accompaniment music 70. For example, in a brute force solution, each condition is listed out, and then appropriate ones are selected to produce transposed sections of the accompaniment music 70. Text descriptions of the above solution are as follows: a plurality of sections of the accompaniment music 51 has a total of m sections (in the present embodiment, m=12). Based on time, the sections are divided into n groups of transposed sections of the accompaniment music 70 (in the present embodiment, n=3). Each group of transposed sections of the accompaniment music 70 has a total of y sections of the accompaniment music 51. (In the present embodiment, the 3 groups of transposed sections of the accompaniment music 70 respectively have y values of 4, 7, and 1). The number of [keys] transposed for each group of transposed sections of the accompaniment music 70 is the same (including 0 transposals). The ranges of the numbers are as follows: $5 \le m \le 1000$, $3 \le n \le m-2$, $1 \le y \le 500$.

For the above method, it is recommended to seek the smallest n. Based on the above explanations for FIG. 6 and FIG. 7, the smallest n can be obtained (in the present embodiment, n=3). Now please refer to FIG. 8, which is another result. Here, n is also 3, and the $11^{th}$ and $12^{th}$ sections of the accompaniment music 51 can be grouped into one transposed section of the accompaniment music 70; i.e., y=2. The possible advantage is that there are two sections of the accompaniment music 51 that can be transposed together. This is probably better than transposing one single section of the accompaniment music 51.

Please refer to FIG. 9, wherein there are 5 transposed sections of the accompaniment music 70; i.e., n=5. Such a solution can also allow the singer to sing the song, but the whole song is divided into 5 transposed sections. Dividing the song into 3 sections, as shown in FIG. 7 and FIG. 8, is probably better.

It is to be noted that the above embodiments are provided for descriptive purposes only. The scope of the present invention shall be based on the claims and shall not be limited to the above embodiments. The method disclosed in the present invention can be used in real-time processing, for example, by instant computing after the singer selects a song, or by prior processing, for example, on an electronic device 10 for adjusting accompaniment music (which can be a home-based or cloud server) containing 1000 songs grouped for different individuals or based on different vocal ranges of singers (e.g., 50 different vocal ranges of singers), all 1000 songs being computer processed in advance.

What is claimed is:

1. A method of transposing a musical key of accompaniment music, used by an electronic device to adjust an accompaniment music by adjusting a frequency of a plurality of time sections of the accompaniment music for a song, the method comprising:

partitioning the song into a plurality of time sections wherein each time section of the accompaniment music corresponds to each segment of the song by an original singer;

determining a singer's vocal range;

in response to the singer's vocal range being narrower than an overall original vocal range of the song:

comparing the singer's vocal range with the original vocal range for each segment of the song to determine whether the singer's vocal range covers the vocal range of the original singer for each segment of the song; and based on the above step, transposing the musical key of at least one time section of the accompaniment music in response to a time section of the accompaniment music in which the singer's vocal range is narrower than the original vocal range for the corresponding segment, and not transposing the musical key of each time section of the accompaniment music in which the original vocal range is covered by the singer's vocal range, wherein the musical key of at least one of the plurality of time sections is transposed and the musical key of at least one of the plurality of time sections is not transposed.

2. The method of transposing the musical key of accompaniment music as claimed in claim 1, wherein at least two time sections of the accompaniment music are transposed, and the two time sections of the accompaniment music are transposed to different keys.

3. The method of transposing the musical key of accompaniment music as claimed in claim 2, wherein the plurality of time sections of the accompaniment music comprises m time sections divided into n groups of transposed time sections of the accompaniment music based on time, with each n group of transposed time sections having y time sections of the accompaniment music, wherein: within each n group of transposed time sections of the accompaniment music, the number of [keys] by which each time section in the group of transposed time sections is transposed is the same; and $$5 \leq m \leq 1000, 3 \leq n \leq m-2, 1 \leq y \leq 500.$$

4. The method of transposing the musical key of accompaniment music as claimed in claim 3, wherein the method further comprises determining a transposition that results in a smallest value of n.

5. The method of transposing the musical key of accompaniment music as claimed in claim 3, wherein each segment of the song by the original singer is based on each verse of lyrics.

6. The method of transposing the musical key of accompaniment music as claimed in claim 3, which further comprises a step for obtaining the singer's vocal range.

7. An electronic device for adjusting an accompaniment music, used to adjust a frequency of a plurality of time sections of the accompaniment music for a song, wherein each time section of the accompaniment music corresponds to each segment of the song by an original singer; the electronic device comprises:

a processor and a memory;

the memory comprises a software program, the software program configured to determine a singer's vocal range;

when the singer's vocal range is narrower than an overall original vocal range of the song, the electronic device executes the software program to:

compare the singer's vocal range with the original vocal range for each segment of the song to determine whether the singer's vocal range covers the vocal range of the original singer for each segment of the song; and based on the above step, a musical key of at least one time section of the accompaniment music is transposed in response to the singer's vocal range being narrower than the original vocal range for the corresponding segment, and is not transposed in response to original vocal range being covered by the singer's vocal range, wherein the musical key of at least one of the plurality of time sections is transposed and the musical key of at least one of the plurality of time sections is not transposed.

8. The electronic device for adjusting accompaniment music as claimed in claim 7, wherein the musical keys of at least two time sections of the accompaniment music are transposed, and the two time sections of the accompaniment music are transposed to different musical keys.

9. Tile electronic device for adjusting accompaniment music as claimed in claim 8, wherein the plurality of time sections of the accompaniment music comprises m time sections, which are classified into n groups of transposed time sections of the accompaniment music, with each n group of transposed time sections having y time sections of the accompaniment music, wherein: within each n group of transposed time sections of the accompaniment music, the number of keys by which each time section in the transposed time sections of the accompaniment music are transposed is the same; and $$5 \leq m \leq 1000, 3 \leq n \leq m-2, 1 \leq y \leq 500.$$

10. The electronic device for adjusting accompaniment music as claimed in claim 9, wherein the electronic device executes the software program to determine a transposition that results in a smallest value of n.

11. The electronic device for adjusting accompaniment music as claimed in claim 9, wherein each segment of the song by the original singer is divided on the basis of each verse of lyrics.

12. The electronic device for adjusting accompaniment music as claimed in claim 9, wherein the electronic device executes the software program further to obtain the singer's vocal range.

* * * * *